US006227523B1

(12) United States Patent
Haberlen

(10) Patent No.: US 6,227,523 B1
(45) Date of Patent: May 8, 2001

(54) BARRIER DEVICE FOR PREVENTING PASSAGE

(76) Inventor: Günter Haberlen, Heinrich-Honer-Strasse 9a, 78573 Wurmlingen (DE)

( * ) Notice: Subject to any disclaimer, the term of this patent is extended or adjusted under 35 U.S.C. 154(b) by 0 days.

(21) Appl. No.: 09/445,323

(22) PCT Filed: May 26, 1998

(86) PCT No.: PCT/DE98/01433

§ 371 Date: Dec. 6, 1999

§ 102(e) Date: Dec. 6, 1999

(87) PCT Pub. No.: WO98/55726

PCT Pub. Date: Dec. 10, 1998

(30) Foreign Application Priority Data

Jun. 4, 1997 (DE) ..... 197 23 315

(51) Int. Cl.[7] ..... E06B 11/00

(52) U.S. Cl. ..... 256/59; 246/127; 49/131; 404/6

(58) Field of Search ..... 256/13.1, 14, 17, 256/59; 246/127; 49/124, 131, 132, 133, 134, 323; 404/6

(56) References Cited

U.S. PATENT DOCUMENTS

| | | | | |
|---|---|---|---|---|
| 1,245,061 | * | 10/1917 | Strieter | 404/6 |
| 1,259,060 | * | 3/1918 | West | 49/361 |
| 1,531,118 | * | 3/1925 | McManus | 104/30 |
| 1,661,051 | * | 2/1928 | Siano | 246/127 |
| 1,788,721 | * | 1/1931 | Klomparens | 49/124 X |
| 2,531,310 | | 11/1950 | Tonn | 160/223 |
| 4,576,508 | * | 3/1986 | Dickinson | 404/6 |
| 4,922,655 | * | 5/1990 | Seal | 49/131 |
| 5,118,056 | * | 6/1992 | Jeanise | 246/127 |
| 5,474,017 | | 12/1995 | Mohebbi et al. . | |
| 5,498,100 | * | 3/1996 | Guernsey | 404/6 |
| 5,762,443 | * | 6/1998 | Gelfand et al. | 404/6 |
| 5,993,104 | * | 11/1999 | Marcotullio et al. | 404/6 |
| 6,105,905 | * | 8/2000 | Spence | 246/127 |

FOREIGN PATENT DOCUMENTS

| | | | |
|---|---|---|---|
| 1 659 403 | 11/1966 | (DE) | E06B/3/92 |
| 1 915 075 | 10/1969 | (DE) . | |
| 36 11 372 C2 | 10/1987 | (DE) | E01F/13/00 |
| 93 15 671 | 4/1994 | (DE) | E01F/13/00 |
| 2 699 208 | 6/1974 | (FR) | E04F/11/18 |

* cited by examiner

*Primary Examiner*—Lynne H. Browne
*Assistant Examiner*—David Bochna
(74) *Attorney, Agent, or Firm*—Pendorf & Cutliff

(57) ABSTRACT

A barrier device for preventing passage, having a simple construction and capable of being lowered into a shallow trench. The barrier device, preferably constructed as a gate for preventing passage to and from buildings or property, comprises a moveable framework for supporting a telescopic barrier arrangement and a movement device for moving the support device between a barrier position and an open position of the telescopic barrier arrangement. The telescopic barrier arrangement is shortened during the movement from the barrier position to the open position with the help of a counter-force which can be applied by a sunken base, and extended in the opposite direction during movement from the open position to the barrier position, with the help of the force of gravity.

6 Claims, 2 Drawing Sheets

BARRIER DEVICE FOR PREVENTING PASSAGE

BACKGROUND OF THE INVENTION

1. Field of the Invention

The present invention concerns a barrier device, and more specifically, a gate for blocking and opening access to buildings or property.

2. Description of the Related Art

While the general utility of the barrier device of the present invention is not limited to conventional entryways, such as those for cages, in particular animal cages, or paths, the following description of the present invention and the problem addressed therewith will be oriented towards the above mentioned gates.

The securing of entryways of public or private property, such as the land of companies or industries, buildings, and the like against unauthorized access such as automobile access can occur in a conventional manner using this type of gate.

Swinging gates and sliding gates are known, which for opening and closing must be moved in their entirety. An example of this would be a sliding gate with vertical bars, which must be pushed sideways. These gates require much above-ground space for displacement.

Foldable scissors-gates overcome the problem of the high space requirement, but however exhibit other disadvantages, for example they are as a rule easy to climb over, are difficult to operate and are liable to wear.

As an alternative sunken gates have been developed, which can partially or completely disappear into the ground for opening access along the passageway. Such gates however require a deep trench into which to sink, which on the one hand is labor intensive to provide and on the other hand requires a perimeter for its positioning which may conflict with cables, pipes and the like buried in the ground.

From DE-PS-36 11 372 there is known a driveway blocking gate perpendicular to a street, with a trench and a gate which can be lowered into the trench via a hydraulic cylinder. The gate element is comprised of an upper horizontally running steel beam and multiple vertical steel beams connected thereto.

Also disclosed in this publication is a gate with gate slats, which at their upper end are connected via a head beam, which can be lowered in the barrier element. For this the gate slats extend through boreholes of the upper horizontally running steel beam of the barrier device. The head beam is likewise raised and lowered via hydraulic cylinders, which support themselves on the lower side of the vertical steel beam.

In this known barrier the trench depth corresponds to the height of the vertical steel beam plus the height of the hydraulic cylinder. The total height of the barrier is the sum of the stroke height of the horizontal steel beam and the stroke height of the gate. This design reduces a certain portion of the depth of the trench, is however complex and expensive.

SUMMARY OF THE INVENTION

The task of the present invention thus resides in the provision of an improved barrier device, in particular a gate for blocking and opening a through-fare for buildings or grounds, which can be lowered into a shallow trench depth and can be constructed in a simple manner.

A barrier device, in particular a gate for blocking and opening passage through a passageway for buildings or grounds, which includes a moveable framework for supporting a telescopic barrier arrangement; and a movement device for moving the framework between a blocking position and an open position of the telescopic barrier device; wherein the telescopic barrier device during movement from the blocking to the open position can be shortened with the aid of a counter-force which can be applied by a lowered base; and wherein the telescopic barrier device for movement from the open to the blocking position can be lengthened in the appropriate reverse manner by the action of the counter-force.

Of particular advantage in the inventive barrier device is the simplified design, which requires no complex mechanism that must act directly on the telescoping parts.

The present invention is predicated upon the idea of utilizing the gravitational force for pulling out the telescopic barrier device and the counter-force of a lowered base for contracting. For this the lowered base, for example the ground or a subterranean base plate, need not necessarily be provided in a through-going or continuous sunken trench, but rather the sunken trench can correspond to the geometric layout of the telescopic barrier device. As a result one can, by selecting a suitable design and position of the telescopic barrier device, take into consideration the lines buried in the ground and avoid interference.

In accordance with a preferred embodiment, the frame is comprised of two essentially vertical longitudinal supports and a first cross-beam guided essentially horizontally therein and moveable by the movement device. This is a particularly economical design.

In accordance with a further preferred embodiment, the telescopic barrier device is comprised of a plurality of telescopic rods, which on their one end are provided on the first cross-beam in a specified geometric arrangement.

According to a further preferred embodiment, the telescopic rods are provided on the first cross-beam in a linear arrangement.

According to a further preferred embodiment the framework includes an essentially horizontal second cross-beam, with the telescoping rods connected at one end to the second cross beam in an appropriate geometric arrangement. This design is characterized by being particularly stable.

According to a further preferred embodiment, the second crossbeam is guided in the two longitudinal supports.

According to a further preferred embodiment, the two longitudinal supports are provided in a sunken trench, of which the floor forms the base and which has such a depth that the first cross beam, when the barrier is in the open position, is flush with the ground and the telescopic barrier device is completely contracted.

According to a further preferred embodiment the second cross beam, when the barrier is in the raised or blocking position, closes the trench and is flush with the ground. This design prevents an undesired raising of the second cross-beam.

According to a further preferred embodiment, the telescopic rods are comprised of hollow tubes of varying diameters inserted into each other. This design provides for a problem-free contraction and extension of the telescopic rods.

BRIEF DESCRIPTION OF THE DRAWINGS

An illustrative embodiment of the invention is shown in the figures and will be discussed in greater detail in the following description.

There is shown.

DETAILED DESCRIPTION OF THE INVENTION

In the figures the same reference numbers refer to the same or functionally equivalent components.

Figure 1:
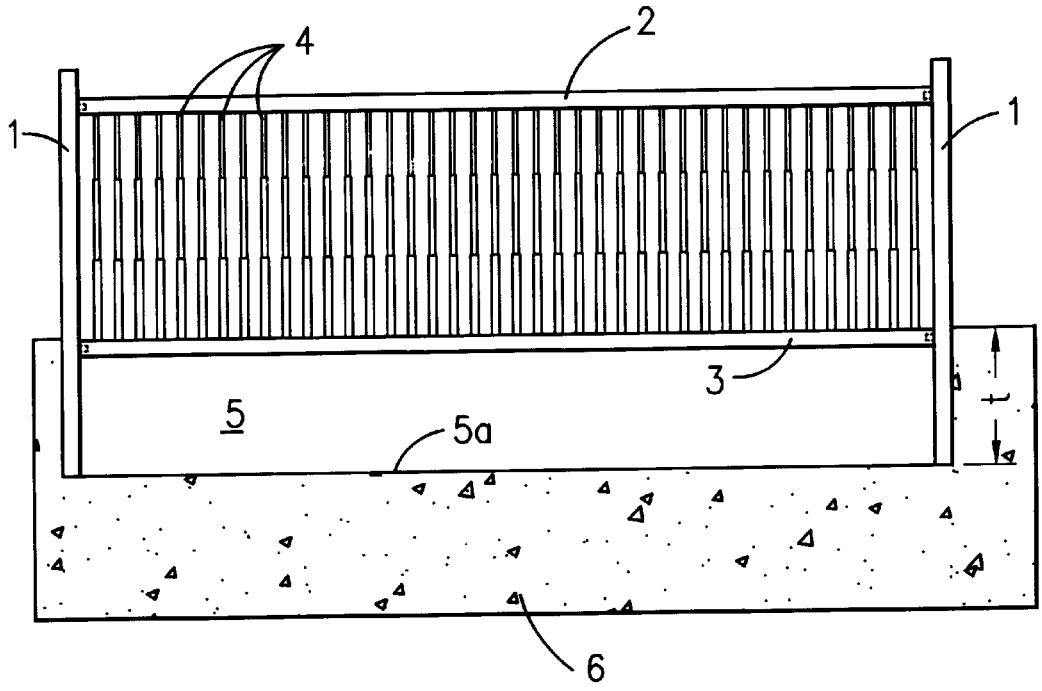
FIG. 1 a gate which can be lowered telescopically, as an illustrative embodiment of the present invention, in the raised or blocking position, viewed from its broad side.

FIG. 1 shows a gate which can be lowered telescopically as an illustrative embodiment of the present invention in the raised or blocking position in broad side view.

In FIG. 1 reference numbers 1, 1' indicate a first and a second vertical longitudinal support, 2 indicates a horizontal upper cross-beam; 3 indicates a horizontal lower cross-beam, 4 indicates vertical telescoping rods, 5 indicates a sunken trench, 5*a* the base or floor of the sunken trench and 6 indicates the ground.

The first and the second vertical longitudinal supports 1, 1' are both anchored in the ground 6 on the sides of the sunken trench 5 to the depth t. The horizontal upper cross-beam 2 and the horizontal lower cross-beam 3 are mounted vertically slideable in first and second vertical longitudinal supports 1, 1'. Between the horizontal upper cross-beam 2 and the horizontal lower cross-beam 3 there are provided the telescopically collapsible or as the case may be extendable telescopic rods 4 in a linear, parallel arrangement.

The upper horizontal cross-beam 2 is moveable between a blocking position and an open position by means of a (not shown) movement device, that is, it can be moved up and down. The lower horizontal cross-beam 3 in comparison, in the shown embodiment, is mounted for vertical displacement essentially between the first and second vertical longitudinal supports 1, 1' and is not directly driven for movement, but rather indirectly, via its connection to the telescopic rods 4.

In the illustration according to FIG. 1 the telescopic rods 4 are extended under the influence of gravity, and block the passageway defined between the two vertical longitudinal supports 1, 1'. Thereby the extension height of the upper horizontal cross-beam 2 is so dimensioned, that the lower horizontal cross-beam 3 closes off the sunken trench flush with the ground.

The lower horizontal transverse support 3 is at this time still inside the sunken trench 5 and at its upper edge. Thereby it is not accessible from the outside, and cannot be raised. When desired it is possible to provide an upward acting blocking latch (not shown) in the guideway of the two vertical longitudinal supports 1, 1'.

Figure 2:
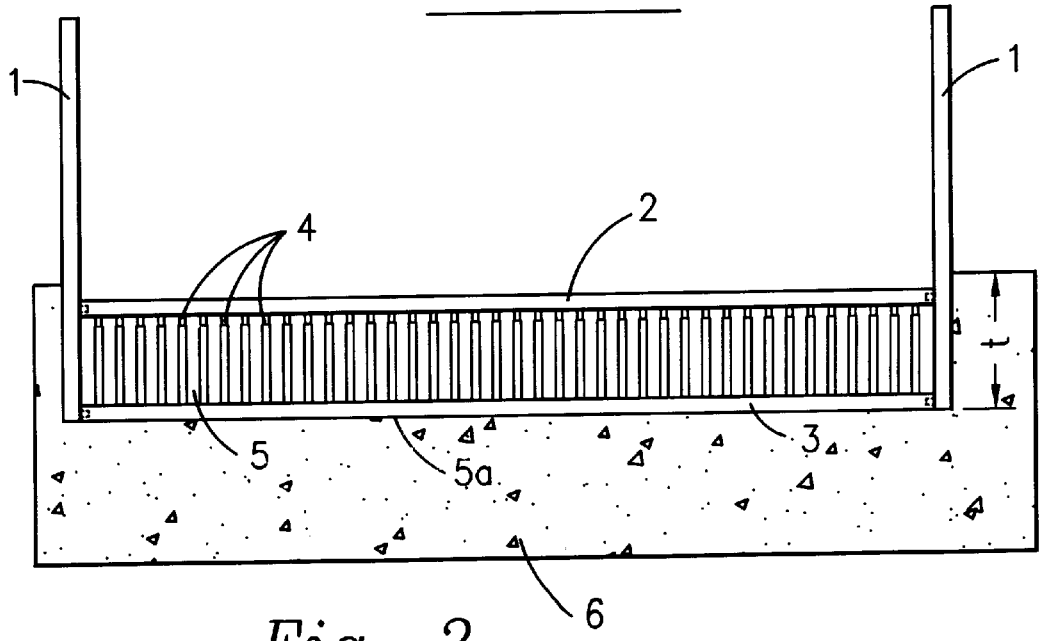
FIG. 2 the gate which can be lowered telescopically according to FIG. 1, in the lowered or open position, viewed from its broad side.

FIG. 2 shows the gate that can be lowered telescopically according to FIG. 1 in the open position.

For the opening of the gate, the upper horizontal cross-beam 2 is moved downwards in its guideway in the two vertical longitudinal supports 1, 1'. While this is taking place first the lower horizontal cross-beam 3 with extended telescopic rods 4 sinks into the sunken trench 5, until it contacts the base 5*a* thereof. During the further lowering of the upper horizontal cross-beam 2 the telescopic rods 4 are collapsed under the influence of the counter-force provided by the base 5*a*.

In the case of the completely opened or lowered gate, the upper cross-beam 2 closes off the sunken trench flush with the ground, and the telescopic rods 4 are completely slid into each other.

In the following the construction of the telescopic rods 4 of the gate according to FIG. 1 and 2 is described in greater detail.

Figure 3:
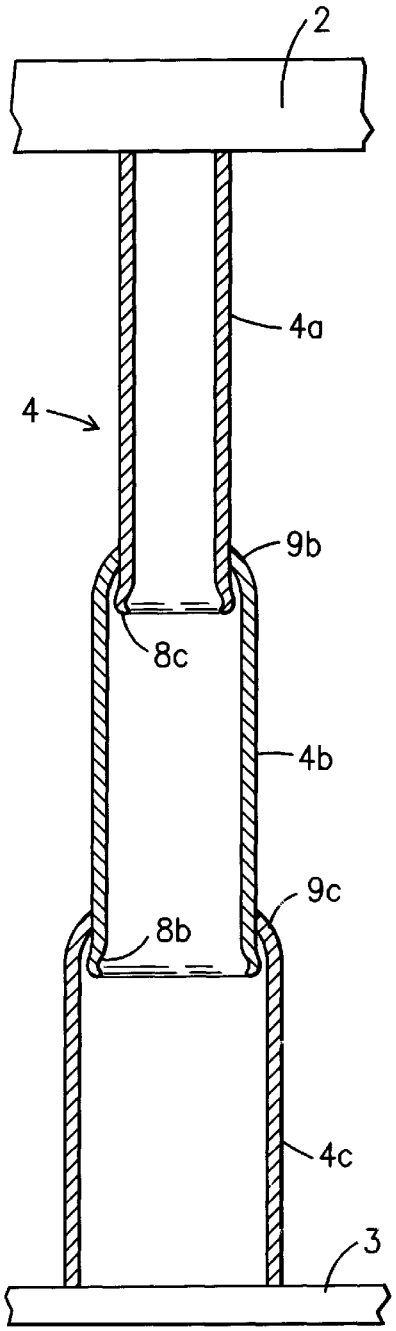
FIG. 3 an enlarged schematic representation of a telescopic rod of the gate which can be lowered telescopically according to FIG. 1 and 2 in the blocking position.

FIG. 3 shows an enlarged schematic representation of a telescopic rod of the gate that can be lowered telescopically according to FIG. 1 and 2 in the blocking position.

In FIG. 3 the reference numbers 4*a*, 4*b*and 4*c* designate a first, second, and in certain cases third, hollow tube with a respectively increasing diameter.

The hollow tubes 4*a* and 4*b* exhibit on their respectively lower ends a ring shaped widening 8*a* or, as the case may be, 8*b*. The hollow tubes 4*b* and 4*c* exhibit on their respective upper ends a ring shaped constriction 9*b* or, as the case may be, 9*c*. The hollow tube 4*a* at its upper end is secured to the upper horizontal cross-beam 2, and the hollow tube 4*c* at its lower end is connected to the lower horizontal cross-beam 3.

In the shown blocking position of the gate, the widenings 8*a* or, as the case may be, 8*b* cooperate with the corresponding constrictions 9*b* or, as the case may be, 9*c* in such a manner, that in the case that the lower horizontal cross-beam 3 is raised from the base 5*a* the hollow tubes 4*a*, 4*b* and 4*c* cannot be completely pulled out of each other but rather are blocked in the manner of an end-stop.

Figure 4:
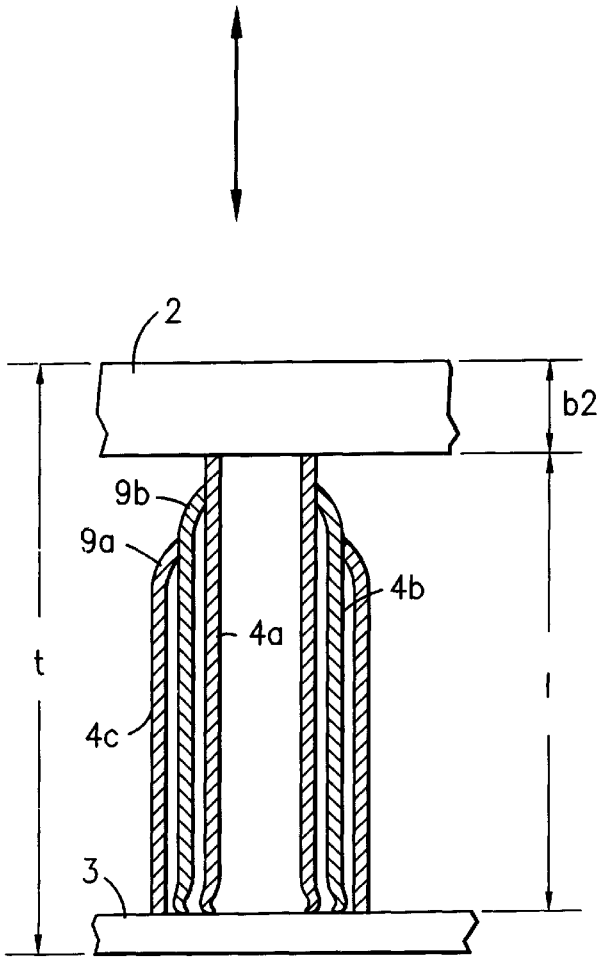
FIG. 4 an enlarged schematic representation of a telescopic rod of the gate which can be lowered telescopically according to FIG. 1 and 2 in the open position.

FIG. 4 shows an enlarged schematic representation of a telescopic rod of the gate which can be lowered telescopically according to FIG. 1 and 2 in the opened or lowered position.

In the shown opened position of the gate the widenings 8*a* or as the case may be 8*b* act in such a manner, that when the horizontal transverse support 3 rests on the base 5*a* the hollow tubes 4*a* and 4*b* likewise rest thereupon supported in the manner of an end-stop.

The total of the length 1 of the hollow tubes 4*a* and the breadth b2 or as the case may be b3 of the two horizontal cross-beams 2, 3 determine the minimum depth t of the sunken trench 5.

Although the present invention has been described on the basis of an illustrative embodiment, it is not to be considered limited thereto but rather can be modified in various ways.

The number of hollow tubes 4*a*, 4*b*, 4*c* is not limited to three, but rather can be any amount depending on the height and stability requirements. As to the number of hollow tubes used to achieve any given stroke height is increased, the length of the longest hollow tube is made smaller, which determines the minimal depth t of the sunken trench 5.

Further, the second cross-beam 3 is not absolutely required. When it is omitted, then the design of the sunken trench can be simplified in such a manner that only a shallow recess for the first transverse support 2, and according to the thickness thereof, need be provided, this recess, at the positions corresponding to the individual telescopic rods, being in communication with holes for receiving the telescopic rods. These holes can be provided with reinforcement at their circumference for increasing stability.

Further, the telescopic barrier device is in no way limited to the linear arrangement of the telescopic rods 4, but rather any of various telescopic elements can be provided in any possible geometric arrangement.

| Reference Number List | |
|---|---|
| 1, 1' | vertical support |
| 2 | upper horizontal cross-beam |
| 3 | lower horizontal cross-beam |
| 4 | telescoping rod |
| 5 | sunken trench |
| 6 | ground |
| t | depth of sunken trench |
| 4a, 4b, 4c | hollow tubes |
| 8a, 8b | widenings |
| 9b, 9c | constrictions |
| 1 | length of hollow tubes 4a |
| b2 | thickness of upper horizontal transverse support 2 |
| b3 | thickness of lower horizontal transverse support 3 |

What is claimed is:

1. Barrier comprising:

a sunken trench having an upper perimeter at ground level and a lower level defining a base;

two essentially vertical supports (1, 1') each of which having an upper end and a lower end, said lower end extending into said sunken trench (5), an upper essentially horizontal cross-beam (2) having a top side and a bottom side and having first and second ends guided in said vertical supports (1, 1') and moveable upwards to a raised position and downwards to an open position, a lower essentially horizontal cross-beam (3) having a top side and a bottom side and having first and second ends guided in said vertical supports (1, 1'), and telescopic barrier elements (4; 4*a*, 4*b*, 4*c*) having first and second ends, which are connected at one end with the upper cross-beam (2) and at the other end with the lower cross-beam (3), wherein raising said upper cross-beam (2) causes said barrier elements (4; 4*a*, 4*b*, 4*c*) to be telescopically extended by the weight of the lower cross-beam (3), and wherein the lower cross-beam (3) remains in the sunken trench (5) when the upper cross-beam is in the raised position, and wherein lowering said upper cross-beam (3) to the open position causes said lower transverse support (3) to come into contact with said base (5*a*) of said sunken trench (5) and to telescopically constrict said barrier elements (4; 4*a*, 4*b*, 4*c*) in the sunken trench (5).

2. Barrier according to claim 1, wherein said top side of said upper cross-beam (2), when in the open position, closes off the sunken trench (5) flush with the ground.

3. Barrier according to claim 1, wherein said top side of said lower cross-beam (3), when in the blocking position, closes off the sunken trench (5) flush with the ground.

4. Barrier according to claim 1, wherein said telescopic barrier elements are comprised of a number of parallel telescopic rods (4; 4*a*, 4*b*, 4*c*) provided parallel to each other and extending between the upper cross-beam (2) and the lower cross-beam (3).

5. Barrier according to claim 4, wherein said telescopic rods are comprised of hollow tubes (4*a*, 4*b*, 4*c*) of varying diameters and slideable into each other.

6. Barrier according to claim 1, wherein said base (5*a*) of the sunken trench (5) forms the base with which the lower cross-beam (3) comes into contact.

* * * * *